US009187214B2

(12) United States Patent
Brunger

(10) Patent No.: US 9,187,214 B2
(45) Date of Patent: Nov. 17, 2015

(54) BAG ARRANGEMENT

(75) Inventor: Philip Charles Brunger, Worcester (GB)

(73) Assignee: BF Innovation, Ltd., Worcestershite (GB)

( * ) Notice: Subject to any disclaimer, the term of this patent is extended or adjusted under 35 U.S.C. 154(b) by 99 days.

(21) Appl. No.: 13/885,730

(22) PCT Filed: Nov. 21, 2011

(86) PCT No.: PCT/GB2011/052282

§ 371 (c)(1),
(2), (4) Date: May 16, 2013

(87) PCT Pub. No.: WO2012/066361

PCT Pub. Date: May 24, 2012

(65) Prior Publication Data

US 2013/0236127 A1 Sep. 12, 2013

(30) Foreign Application Priority Data

Nov. 19, 2010 (GB) ..... 1019608.7

(51) Int. Cl.

| | |
|---|---|
| ***B65D 33/00*** | (2006.01) |
| ***A45C 9/00*** | (2006.01) |
| ***G09F 17/00*** | (2006.01) |
| ***B31B 1/00*** | (2006.01) |

(52) U.S. Cl.
CPC . *B65D 33/00* (2013.01); *A45C 9/00* (2013.01); *B31B 1/00* (2013.01); *G09F 17/00* (2013.01)

(58) Field of Classification Search
CPC ..... A45C 9/00; A45F 4/02
USPC ..... 383/4, 64, 10
See application file for complete search history.

(56) References Cited

U.S. PATENT DOCUMENTS

| | | | | |
|---|---|---|---|---|
| 2,909,147 | A | 10/1959 | Crowder | |
| 3,042,940 | A * | 7/1962 | Keaton | 5/654 |
| 3,545,604 | A * | 12/1970 | Gunther, Jr. | 206/217 |
| 3,590,864 | A * | 7/1971 | Vechesloff | 135/95 |
| 3,640,242 | A | 2/1972 | Guinn et al. | |
| 4,574,726 | A * | 3/1986 | Sullivan | 116/28 R |
| 5,400,437 | A * | 3/1995 | Koutras | 2/84 |
| 5,937,555 | A * | 8/1999 | Query | 438/14 |
| 6,976,786 | B1 | 12/2005 | Stanley, Jr. | |
| 7,665,412 | B2 * | 2/2010 | Walls | 116/173 |

(Continued)

FOREIGN PATENT DOCUMENTS

| | | | | |
|---|---|---|---|---|
| DE | 29909630 U1 | 10/1999 | | |
| JP | 08328499 A * | 12/1996 | | G09F 17/00 |
| JP | 11119714 A * | 4/1999 | | G09F 17/00 |

(Continued)

OTHER PUBLICATIONS

Machine translation of Japanese Document No. JP 11119714 A. Translated on Oct. 19, 2014.*

(Continued)

*Primary Examiner* — Jes F Pascua
(74) *Attorney, Agent, or Firm* — Olive Law Group, PLLC

(57) ABSTRACT

A bag arrangement for conversion to a flag or vice versa, the arrangement comprising: a bag incorporating a volume for holding goods; and a pole to be provided with the bag and attached or attachable thereto to convert the bag into a flag having a flag pole extending therefrom.

12 Claims, 10 Drawing Sheets

(56) References Cited

U.S. PATENT DOCUMENTS

| | | | | |
|---|---|---|---|---|
| 2007/0107284 | A1* | 5/2007 | Lamothe | 40/597 |
| 2009/0095210 | A1 | 4/2009 | Walls | |

FOREIGN PATENT DOCUMENTS

| | | | | | |
|---|---|---|---|---|---|
| JP | 2001282155 | A | * | 10/2001 | G09F 17/00 |
| JP | 2005141097 | A | * | 6/2005 | G09F 17/00 |
| WO | WO2012066361 | A1 | | 5/2012 | |

OTHER PUBLICATIONS

Int'l. Search Report for corresponding PCT/GB2011/052282 filed Nov. 21, 2011.

GB Examination Report dated Aug. 1, 2012 for the priority application GB1019608.7.

GB Search Report dated Mar. 10, 2011 for the priority application GB1019608.7.

* cited by examiner

BAG ARRANGEMENT

CROSS REFERENCE TO RELATED APPLICATION

This application is a 35 USC 371 application of International PCT Patent Application No. PCT/GB2011/052282 filed on Nov. 21, 2011, and further claims priority to GB1019608.7 filed Nov. 19, 2010, the entire contents of both are hereby incorporated by reference herein.

BACKGROUND

The present invention relates to a bag arrangement. More specifically, the present invention relates to a bag arrangement that may be converted into a flag or vice-versa. In addition the present invention relates to a flag pole configured for use in converting a bag into a flag.

Flags are a common way for showing allegiance to a particular country, location, sports team, person, political party or company. As such it is common to see flags being waved at various sporting, cultural, or political events. It is also common to see flags being statically displayed in various locations such as homes and offices.

Similarly, at such events, as well as trade shows and exhibitions it is usual for bags to be distributed with having indicia such as company, sports team, or other logos, either as promotional items, or containing food or merchandise that has been purchased.

Previously, it has not been recognised that a marketing opportunity exists by combining these two articles into one in a convenient manner to add value to merchandising, food and other products conventionally conveyed in bags. Furthermore it has not been recognised that natural resources may be saved by using a single product for two purposes.

The present invention seeks to overcome, or at least mitigate, the problems of the prior art.

SUMMARY

One aspect of the present invention provides a bag arrangement for conversion to a flag or vice versa, the arrangement comprising: a bag incorporating a volume for holding goods; and a pole to be provided with the bag and attached or attachable thereto to convert the bag into a flag having a flag pole extending therefrom.

The present invention provides a cost effective way of providing an additional use for an existing product that may be particularly effective in the promotional and merchandising markets at sports, musical or cultural events, and as well as at trade shows and the like.

The pole is preferably secured to the bag, more preferably, the pole is embedded within the bag, even more preferably the pole is secured between two panels of material forming a second volume.

The pole may be provided in the volume.

In a preferred embodiment, the pole is heat sealed to the bag.

The bag may comprise a tear-open portion to access the pole.

The pole is advantageously extendible, preferably telescopic so it can be stored within the dimensions of the bag.

The pole may be mechanically engageable with the bag

In a preferred embodiment the bag comprises a mechanical reseal closure formation and the pole is configured to secure thereto Alternatively, the pole may clip to the bag and advantageously comprises formations to pierce the bag and clip thereto.

A second aspect of the present invention provides a flag pole configured to convert a bag into a flag or vice versa, the flag pole comprising a formation to mechanically engage and retain a bag along an edge thereof and thereby form a flag.

In a preferred embodiment the formation is configured to mechanically engage a resealable closure on the bag.

Alternatively, the formation is a clip formation to be clipped to the bag, preferably a formation to pierce the bag and clip thereto.

A third aspect of the present invention provides a method of manufacturing a bag arrangement comprising a step of attaching a pole thereto or providing a pole therewith during manufacture thereof, the pole being subsequently usable as a flag pole for converting the bag arrangement to a flag.

A fourth aspect of the present invention provides flag converted from a bag arrangement, the arrangement comprising: a bag incorporating a volume for holding goods; and a pole to be provided with the bag and attached or attachable thereto to convert the bag into a flag having a flag pole extending therefrom. or comprising a flag pole having a formation to mechanically engage and retain a bag along an edge thereof and thereby form a flag.

A fifth aspect of the present invention provides a kit of parts comprising a flag pole configured to convert a bag into a flag, the flag pole comprising a formation to mechanically engage and retain a bag along an edge thereof and thereby form a flag. and a bag.

BRIEF DESCRIPTION OF THE DRAWINGS

Embodiments of the present invention are now described, by way of example only, with reference to the accompanying drawings in which.

DETAILED DESCRIPTION

Figure 1:
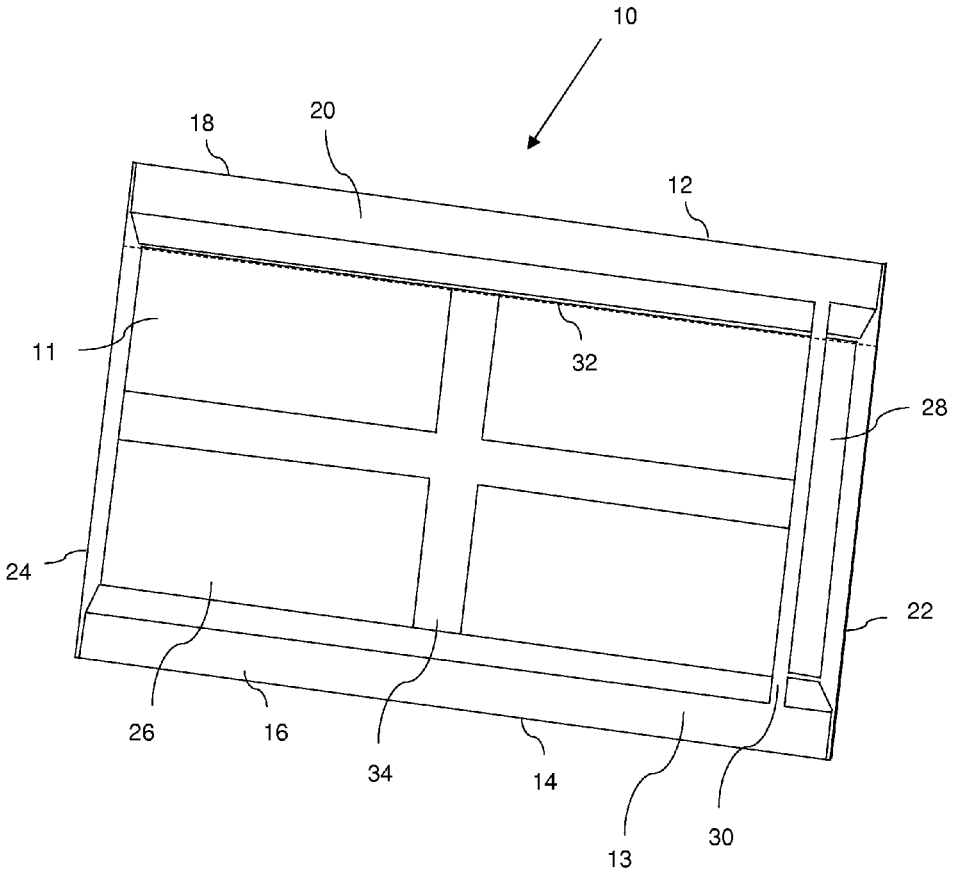
FIG. 1 is an perspective view of a bag arrangement according to a first embodiment of the present invention.

With reference to FIG. 1, a bag arrangement of one embodiment of the present invention indicated generally at 10 comprises a bag 12 formed from first and second overlying panels of plastics material 11 and 13, such as polyethylene or polypropylene (preferably formed integrally in a tube-like manner). The bag further comprises a lower edge 14 having an adjacent a first heat sealed seam 16, an upper edge 18 having an adjacent second heat sealed seam 20, a first side 22 and a second side 24.

The first and second sheets 11 and 13, second side 24, the first and second seams 16 and 20, and a further longitudinal seam 30 set in from the first side 22 define a first volume 26 therebetween. In this first volume 26, one or more suitably dimensioned articles (not shown) may be contained. Examples of such articles may include foodstuffs, printed literature, merchandise, mementos, or the like. A second volume 28 is defined by the first edge 22, first and second seams 16 and 20 the first and second panels 11 and 13 and is separated from the first volume 26 by the longitudinal heat seal seam 30.

In order to access both the first and second volumes 26 and 28 a weakened line, e.g. a perforated tear strip 32 extends parallel to the top edge 18 through the top of the first and second volumes 26 and 28.

In order to function as a flag, printed indicia is preferably printed onto at least one panel 11 or 13 of the bag 12. In this embodiment, as an example, a St George cross 34 is printed thereon.

Figure 2:
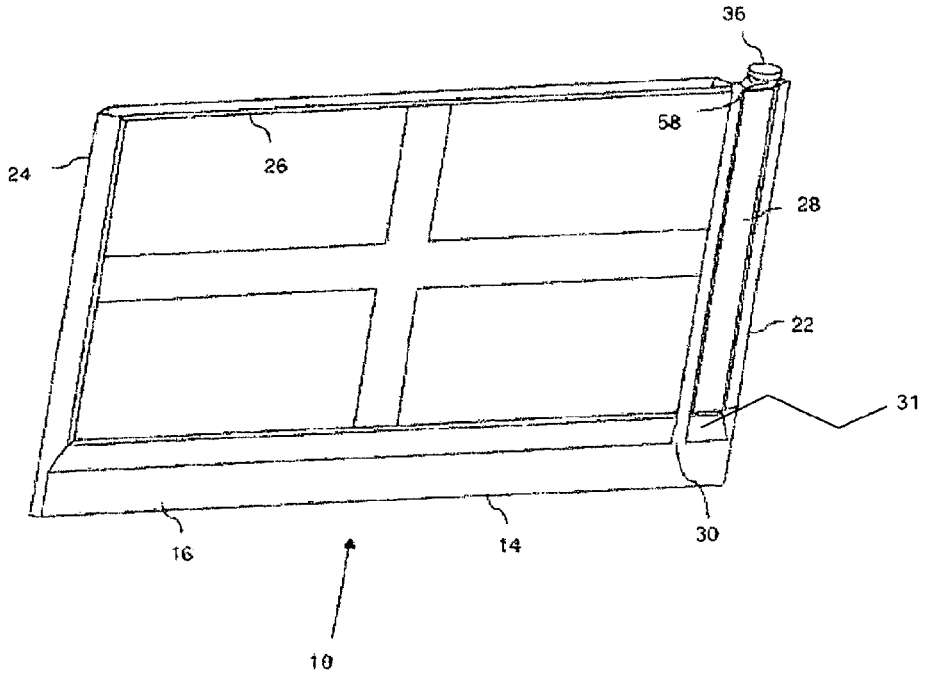
FIG. 2 is a perspective view of the bag arrangement of FIG. 1 with a portion removed.

With reference to FIG. 2, a user has now removed the top of the bag 12 including the heat sealed seam 20 by tearing along the tear strip 32. This enables items to be removed from the first volume 26—e.g. food to be consumed or clothing merchandise to be worn.

Additionally a lower tip 36 of a rigid, telescopic flag pole 38 that is stowed within the second volume 28 is revealed.

Figure 3:
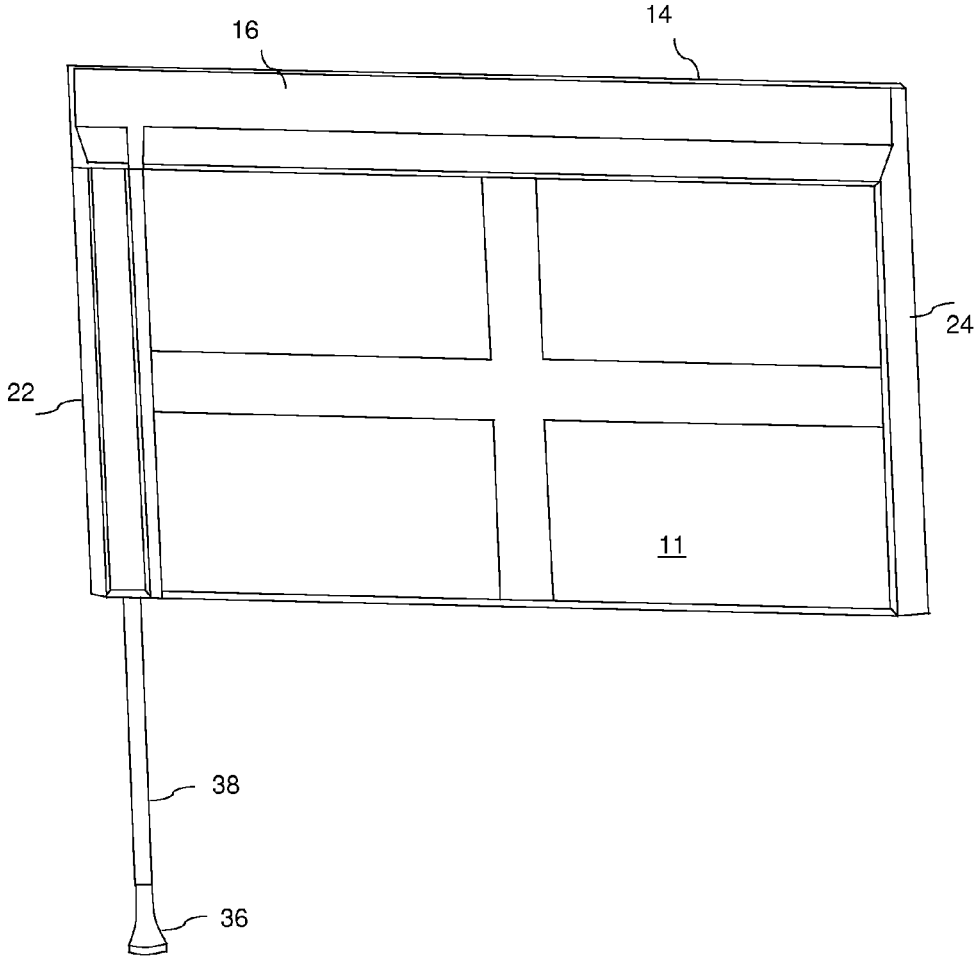
FIG. 3 is a perspective view of a bag arrangement of FIG. 1 inverted and converted to a flag.

As can be seen in FIG. 3, the bag arrangement 10 may then be inverted and the flag pole 38 extended, in order that the visible part of the pole 38 may be grasped by a user (not shown) and waved in a similar manner to a conventional flag.

Figure 8:
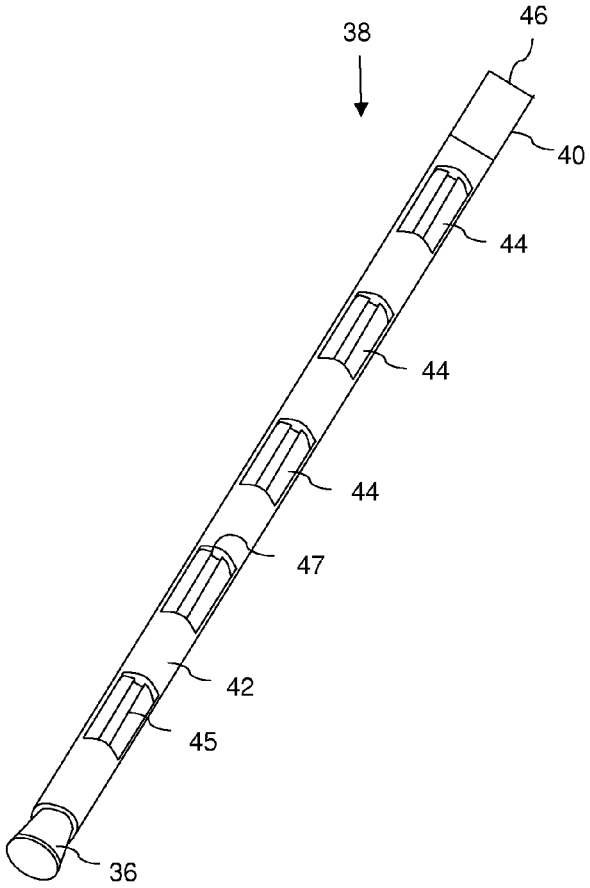
FIG. 8 is a perspective view of a telescopic pole for use in the bag assemblies of the first and second embodiments.
Figure 9:
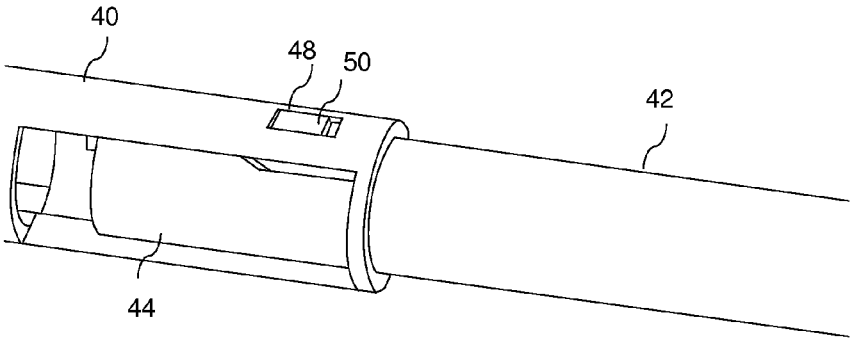
FIG. 9 is an enlarged view of a telescopic connection of FIG. 8.
Figure 10:
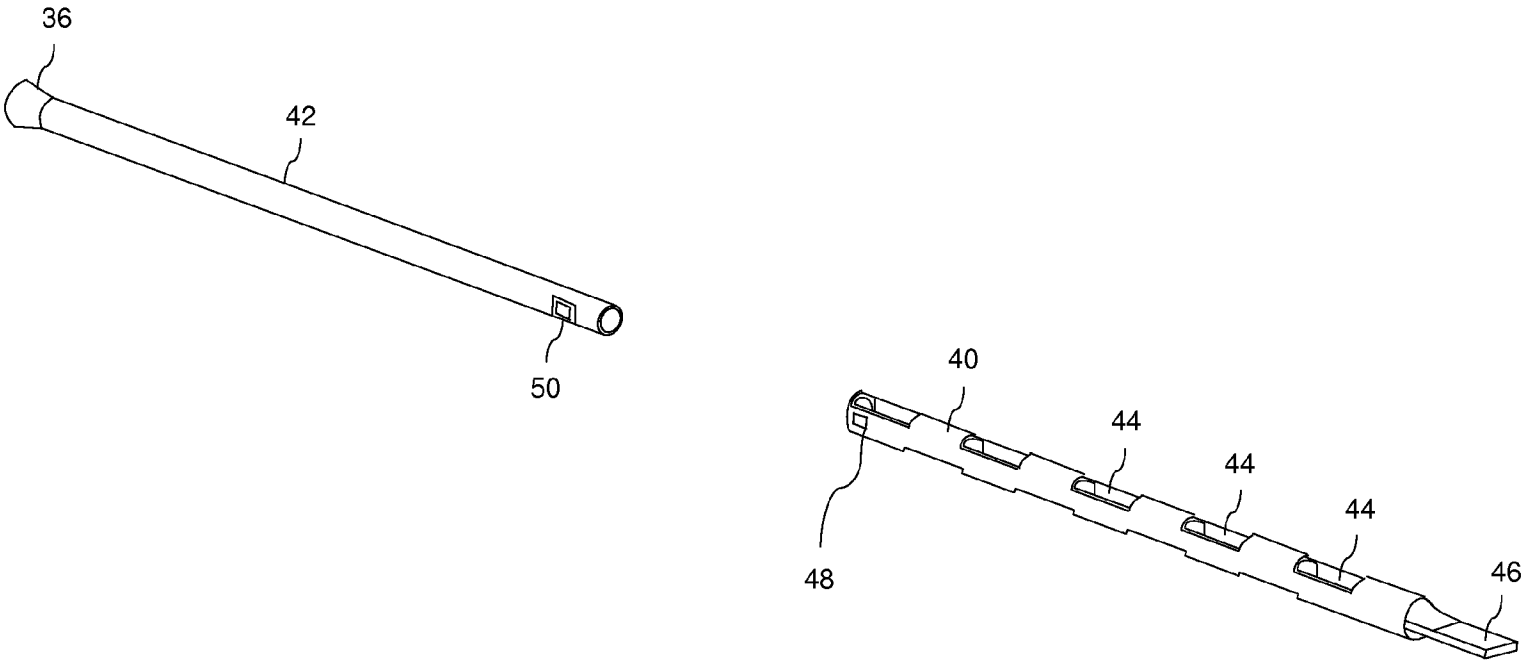
FIG. 10 is an exploded view of the pole of FIG. 8.

With reference to FIGS. 8, 9 and 10, the flag pole 38 can be seen in more detail. The flag pole comprises two components, in this embodiment, an outer sleeve 40 that is intended to be secured, e.g. by heat sealing 31 within the second volume 28 in a fixed position, and a hollow, telescopic inner portion 42 that is a close fit within the outer sleeve. In FIGS. 1 and 2 the inner portion 42 is stowed within the outer sleeve portion, with only the tip 36 protruding therefrom.

The outer sleeve 40 has a series of cut outs 44 provided therein in order to save material and weight. The upper end thereof (in use) thins to a relatively thin tongue 46 so as to provide a transition in the overall arrangement from the relatively thick pole to the relatively thin lower heat sealed seam. In a preferred embodiment, only the tongue 46 is heat sealed to the bag 12. In other embodiments, heat sealing may be undertaken at other locations, or the pole 38 secured by other means, such as adhesive or RF welding.

In order to minimise the risk of the inner portion 42 becoming separated from the outer sleeve 40, an aperture 48 visible in FIG. 9 is provided towards the lower end of the outer sleeve 40 such that when the inner portion 42 is extended fully, a corresponding resiliently loaded tooth 50 springs out from the wall of the inner portion to restrain any further movement. In addition, the inner portion comprises a recessed track 25 that aligns with a complementary ridge provided on the inner face of the sleeve 40 to inhibit relative rotation, in order to ensure correct engagement of the tooth 50 with the aperture 48. In other embodiments, the outer sleeve 40 and inner portion 42 may have other non-circular profiles to restrict rotation.

The bag arrangement 10 of the first embodiment may be manufactured on a vertical form fill and seal (VFFS) machine with minimal adaptation thereof. Thus, if the bag is to be supplied filled with contents in the first volume 26, the pole may be inserted into the second volume 28 simultaneously therewith. Alternatively, if the bag is to be supplied empty, the VFFS machine may simply be used to insert the pole and to seal this into the first seam 16. The bag 12 may then be filled later at a separate location. The flag pole 38 may be formed by injection moulding prior to insertion in the bag. In other embodiments, alternative manufacturing methods may be employed, such as flow-wrap techniques.

Figure 4:
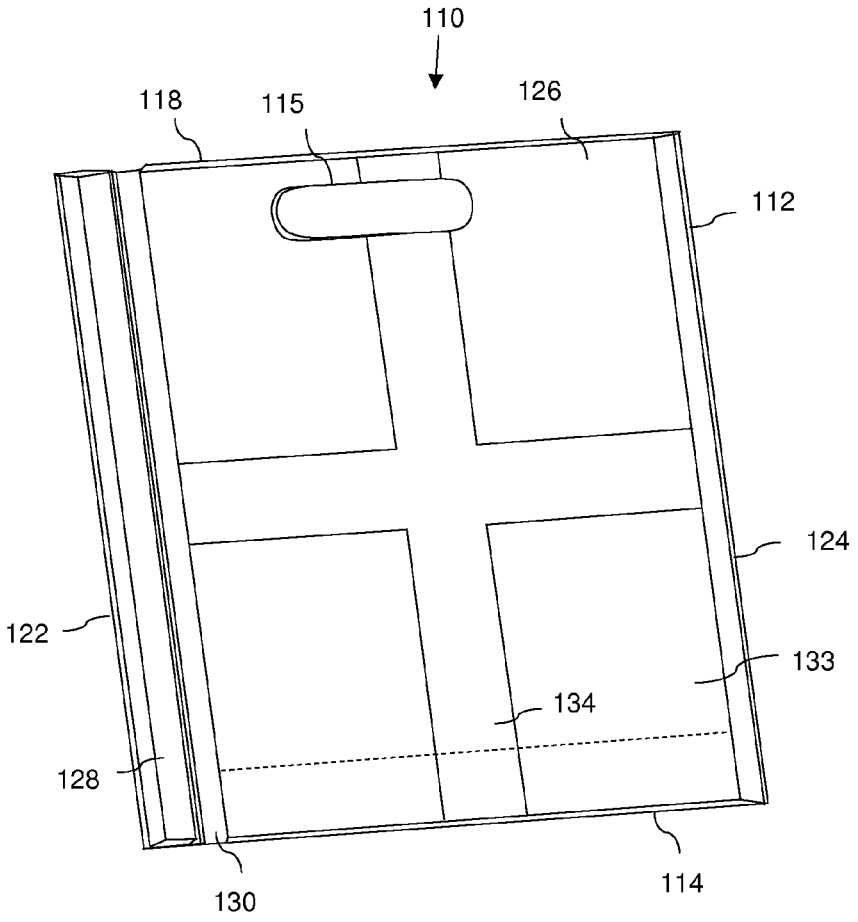
FIG. 4 is a perspective view of a bag arrangement according to a second embodiment of the present invention.
Figure 5:
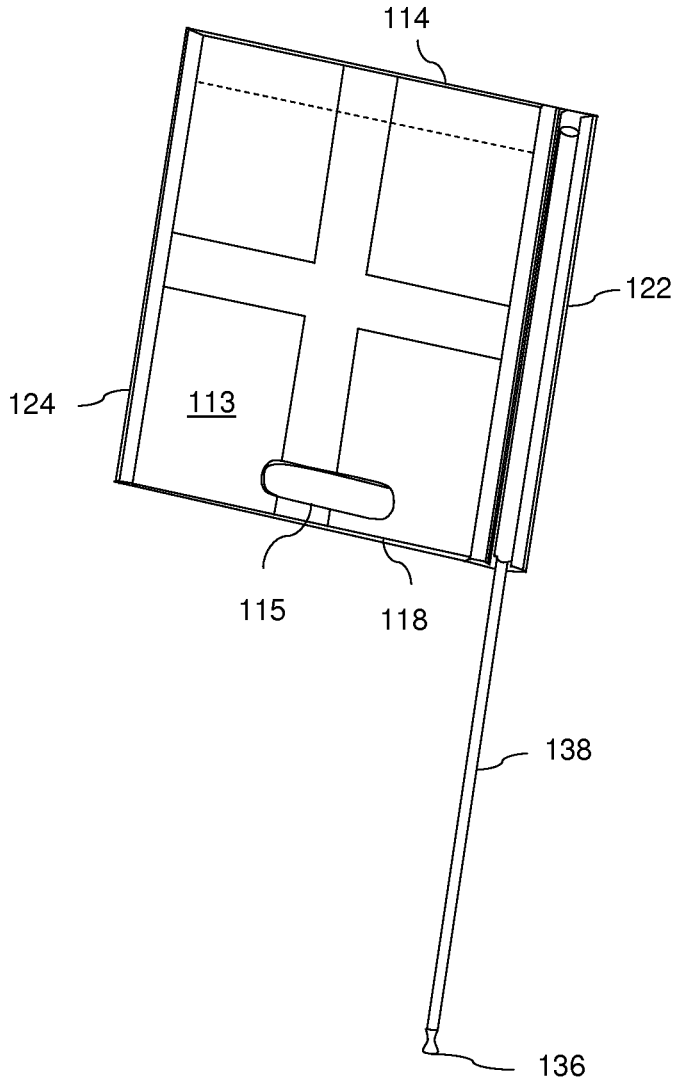
FIG. 5 is a partially cut-away perspective view of the bag arrangement of FIG. 4 when converted to a flag.

FIGS. 4 and 5 illustrate a second embodiment of the present invention, in which like parts are labelled by like numerals, with the addition of the prefix "1". Only those parts that differ from the first embodiment are discussed in detail.

The bag arrangement 110 of this embodiment comprises a larger carrier type bag 112 having a carry handle 115 provided therein.

The bag 112 of this embodiment is in substantially the same format and construction as the bag arrangement 10 of the first embodiment, except that it is provided without the upper heat sealed seam 20 and tear strip arrangement 32. Instead, the top edge 18 is supplied open.

The bag may be formed in a similar manner, but with a different cutting and heat sealing arrangement in a VFFS machine.

With reference to FIG. 5, the bag arrangement 110 is converted to a flag in a similar manner to the bag arrangement 10 of the first embodiment, except that it is not necessary to tear off the top of the bag 12 to access the pole 138.

Figure 6:
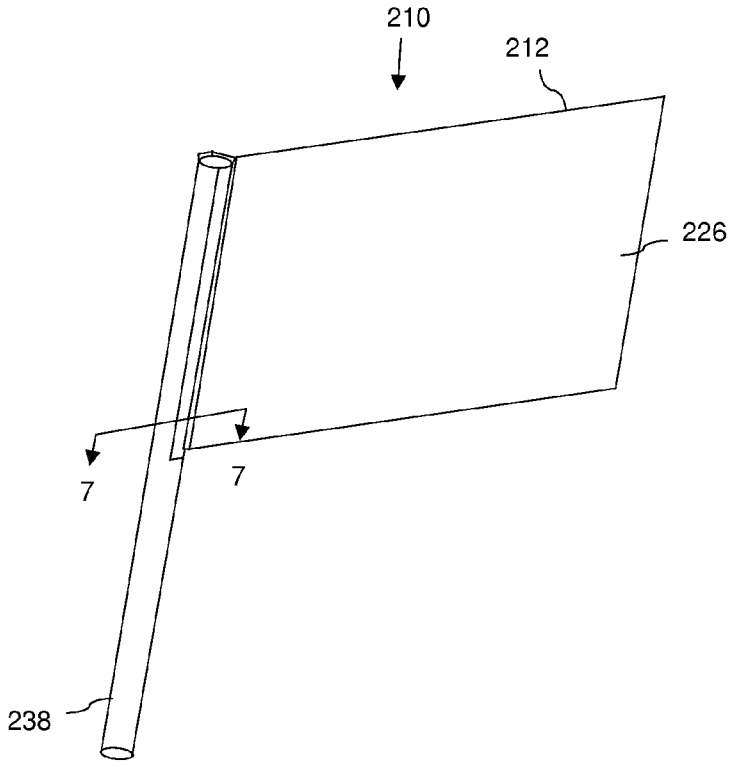
FIG. 6 is a bag arrangement according to a third embodiment of the present invention.
Figure 7:
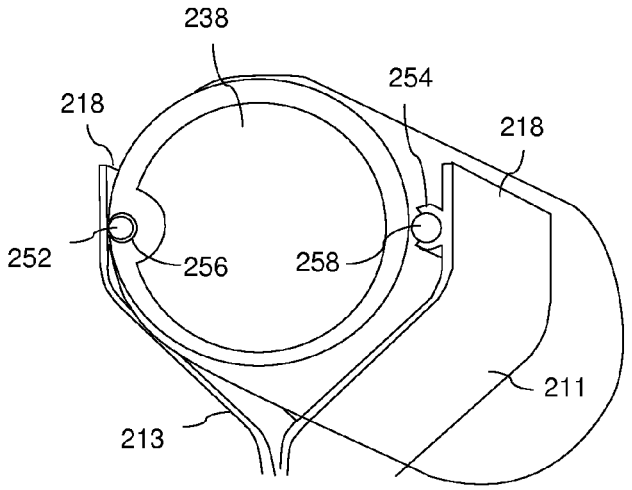
FIG. 7 is an enlarged cross-section view through plane 7-7 of the connection between the bag and pole of FIG. 6.

FIGS. 6 and 7 illustrate a third embodiment of the present invention in which like parts are labelled by like numerals but with the addition of the prefix "2".

The bag arrangement 210 of this embodiment includes a mechanical reseal closure formation in the form of complimentary male and female "zip lock" formations to permit conversion to a flag. In this embodiment, the pole 238 is again telescopic (although in other embodiments it need not be) and is supplied loose within the volume 226 of the bag, optionally along with other contents thereof.

Once the bag has been used for its primary purpose, the pole 238 can be removed, extended, and attached to the opening as described in more detail with reference to FIG. 7.

From FIG. 7 it can be seen that the first and second panels 211 and 213 have a complimentary, facing cylindrical protrusion 252 and a trough 254 extending parallel to and proximate the upper edge. In normal operation the trough receives the protrusion 252 to seal the closure. However, the flag pole 238 is itself provided with a recess 256 to receive the cylindrical protrusion 252 and a cylindrical protrusion 258 that is received by the trough 254. Therefore, the flag pole 238 can be secured to the bag 212 by utilising the existing zip lock features of the closure, and as such no adaptation of the bag itself is required.

In this embodiment flag pole 238 may operate in a similar manner to the first two embodiments, but simply the outer sleeve may be provided with the additional recess and protrusion. The tongue 46 may be omitted, since the flag pole is intended to be supplied loose.

It will be appreciated by those skilled in the art that numerous alternative ways of converting a bag to a flag may be employed. For example, a flag pole may be provided in two halves, connected by a live hinge and with complementary snap fit connections on each half that punch through the bag such that the pole may be clamped around one edge of the bag and secured thereto and the halves secured to each other. Alternatively, the flag pole may be provided as a two part construction in which one part is slid into a complimentary recess in the other with the bag in place, in order to hold the flag pole to the bag. The pole may be foldable, in two or more portions to increase its length. The pole may be formed from two or more parts that can be threadedly connected to each other. Alternatively, an inner part may be compressible or resilient, compressed to fit into an outer part and be frictionally held in a desired position within the outer (either extended or retracted). The pole may be secured to the exterior of the bag. The pole may be formed from other materials e.g. wood, compressed paper, metal in other embodiments. The pole may not be foldable or extendable.

The bag may be manufactured from any number of materials including paper, a paper and plastics laminate, or a woven material. The bags may be gusseted and may be manufactured in a variety of shapes and sizes and using any suitable manufacturing method. For example, the pole could be comoulded or extruded together with the bag. The pole may be provided separately from the bag in order to convert existing, conventional bags to flags. The pole may be heat sealed or otherwise secured to the bag within the first volume (i.e. no longitudinal seam may be provided to form the second volume).

Figure 11:
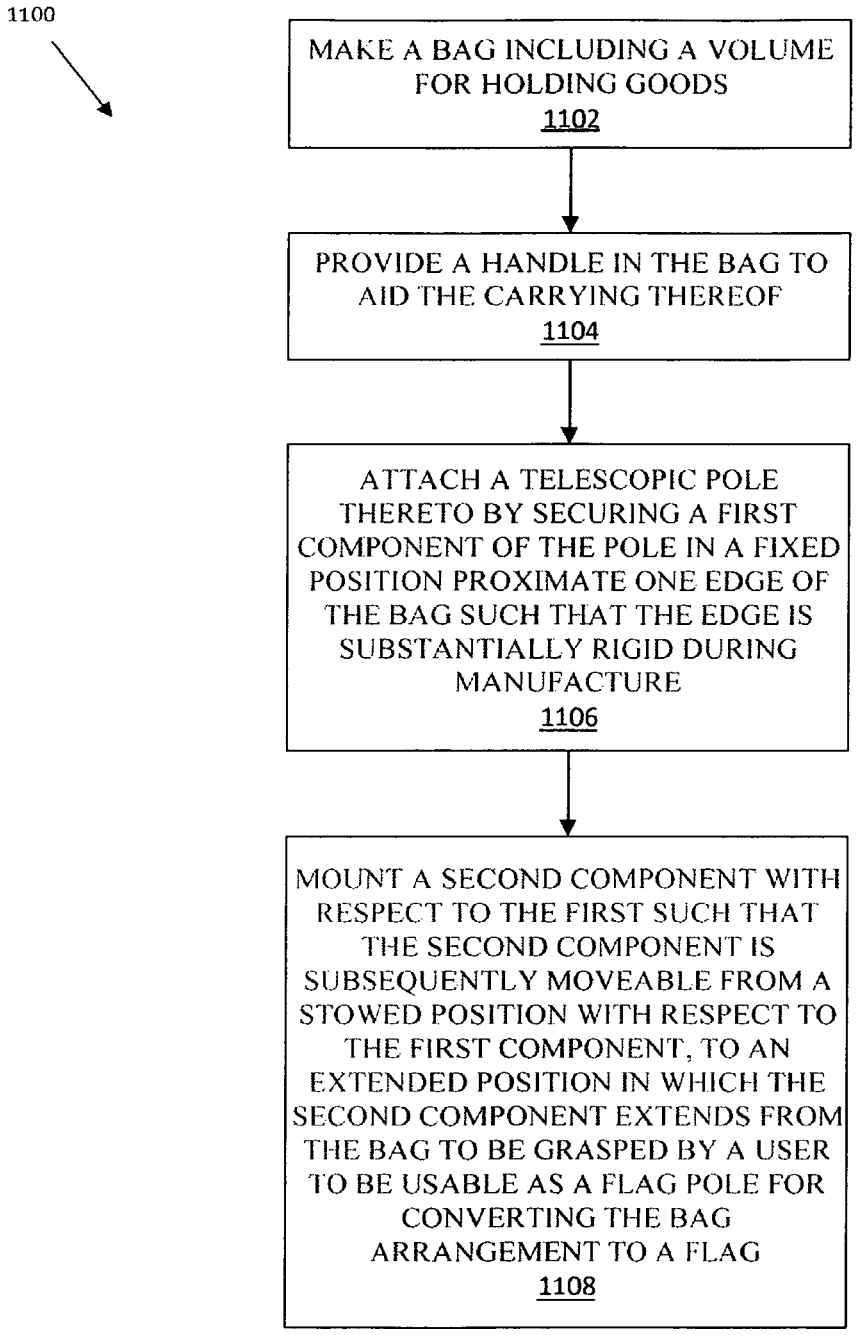
FIG. 11 is a flow chart of a method of manufacturing a bag arrangement.

FIG. 11 is a flow chart of a method of manufacturing a bag arrangement. Referring to FIG. 11, the method includes making 1102 a bag including a volume for holding goods. The method also includes providing 1104 a handle in the bag to aid the carrying thereof. Further, the method includes attaching 1106 a telescopic pole thereto by securing a first component of the pole in a fixed position proximate one edge of the bag such that the edge is substantially rigid during manufacture. The method also includes mounting 1108 a second component with respect to the first such that the second component is subsequently moveable from a stowed position with respect to the first component, to an extended position in which the second component extends from the bag to be grasped by a user to be usable as a flag pole for converting the bag arrangement to a flag.

Figure 12:
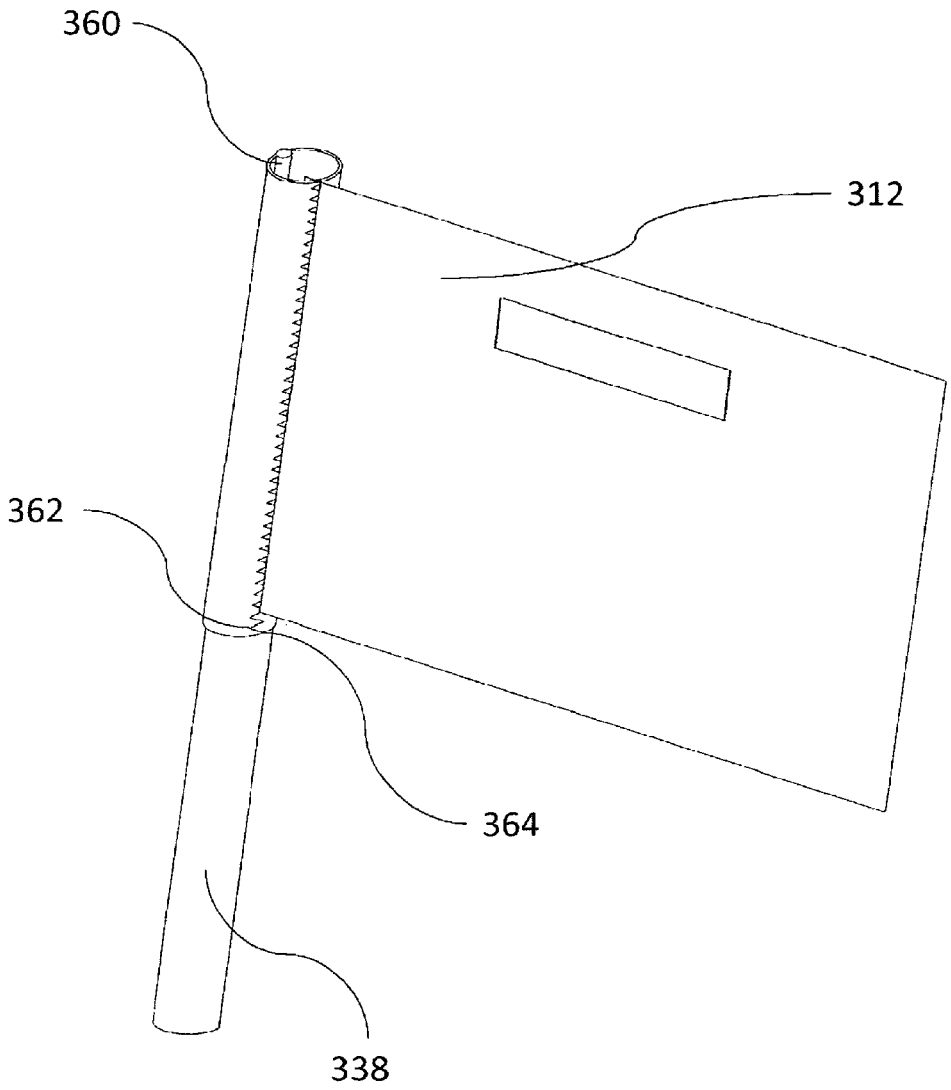
FIG. 12 is a bag arrangement according to an alternative embodiment of the present invention, whereby the flag is clamped to the pole by a toothed snap fit connection arrangement.

It will be appreciated by those skilled in the art that numerous alternative ways of converting a bag to a flag may be employed. For example, referring to FIG. 12, a flag pole 338 may he provided in two halves, connected by a live hinge 360 and with complementary snap fit connections 362, 364 on each half that punch through the hag 312 such that the pole 338 may be clamped around one edge of the hag 312 and secured thereto and the halves secured to each other.

It should be appreciated that terms such as upper and lower, top and bottom as used herein should not be regarded as limiting and are solely used for ease of explanation.

Whilst the invention has been described primarily from the point of view of converting a bag into a flag, it will be appreciated by a person skilled in the art that the same construction may be employed in reverse. In other words, the user may acquire a flag that can subsequently be converted into a bag.

The invention claimed is:

1. A bag arrangement for conversion to a flag or vice-versa, the arrangement comprising:

a bag incorporating a volume for holding goods and a handle to aid the carrying thereof; and a pole provided with the bag and attached thereto to convert the bag into a flag having a flag pole extending therefrom, wherein the pole is telescopic, comprising a first component secured to the bag in a fixed position proximate one edge of the bag such that the edge is substantially rigid, and further comprising a second component moveable from a stowed position with respect to the first component, to an extended position in which the second component extends from the bag to be grasped by a user to be usable as a flag pole for converting the bag arrangement to a flag, wherein the first component and the second component have complementary non-circular profiles to restrict relative rotation therebetween.

2. A bag arrangement according to claim 1 wherein the pole is embedded within the bag.

3. A bag arrangement according to claim 2 wherein the pole is secured between two panels of material forming a second volume.

4. A bag arrangement according to claim 1 wherein the first component of the pole is heat sealed to the bag.

5. A bag arrangement according to claim 1 wherein the pole is mechanically engaged with the bag.

6. A bag arrangement according to claim 5 wherein the pole is clamped to the bag.

7. A bag arrangement according to claim 1, wherein a tooth is provided to prevent the second component being separated from the first component in the extended position.

8. A bag arrangement according to claim 1, wherein the first component is secured proximate a closed edge of the bag.

9. A bag arrangement according to claim 1, wherein the handle is formed by an aperture provided in the bag.

10. A bag arrangement according to claim 1, wherein the first component is substantially the same length as the edge to which it is proximate.

11. A bag arrangement for conversion to a flag or vice-versa, the arrangement comprising:

a bag incorporating a volume for holding goods and a handle to aid the carrying thereof; and a pole provided with the bag and attached thereto to convert the bag into a flag having a flag pole extending therefrom, wherein the pole is telescopic, comprising a first component secured to the bag in a fixed position proximate one edge of the bag such that the edge is substantially rigid, and further comprising a second component moveable from a stowed position with respect to the first component, to an extended position in which the second component extends from the bag to be grasped by a user to be usable as a flag pole for converting the bag arrangement to a flag, wherein the bag comprises a tear-open portion to access the pole.

12. A bag arrangement for conversion to a flag or vice-versa, the arrangement comprising:

a bag incorporating a volume for holding goods and a handle to aid the carrying thereof; and a pole provided with the bag and attached thereto to convert the bag into a flag having a flag pole extending therefrom, wherein the pole is telescopic, comprising a first component secured to the bag in a fixed position proximate one edge of the bag such that the edge is substantially rigid, and further comprising a second component moveable from a stowed position with respect to the first component, to an extended position in which the second component extends from the bag to be grasped by a user to be usable as a flag pole for converting the bag arrangement to a flag wherein the pole comprises formations to pierce the bag and clamp thereto.

* * * * *